US007344412B2

(12) United States Patent
Sato

(10) Patent No.: US 7,344,412 B2
(45) Date of Patent: Mar. 18, 2008

(54) CONNECTOR IN WHICH A MUTUAL DISTANCE BETWEEN CONTACTS IS ADJUSTED AT TERMINAL PORTIONS THEREOF

(75) Inventor: Yukiko Sato, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 11/591,931

(22) Filed: Nov. 2, 2006

(65) Prior Publication Data

US 2007/0099512 A1 May 3, 2007

(30) Foreign Application Priority Data

Nov. 2, 2005 (JP) ..... 2005-319351

(51) Int. Cl.
*H01R 13/648* (2006.01)

(52) U.S. Cl. ..... 439/608

(58) Field of Classification Search ..... 439/608, 439/108, 76.1, 701, 485, 638, 607, 67, 70
See application file for complete search history.

(56) References Cited

U.S. PATENT DOCUMENTS 6,935,870 B2 8/2005 Kato et al.
6,997,755 B2 * 2/2006 Varis ..... 439/701
7,097,506 B2 * 8/2006 Nakada ..... 439/608
2001/0012730 A1 * 8/2001 Ramey et al. ..... 439/608
2002/0055286 A1 * 5/2002 MacDougall et al. ..... 439/108

FOREIGN PATENT DOCUMENTS

JP 2002-334748 11/2002
JP 3564555 9/2004

* cited by examiner

*Primary Examiner*—J. F. Duverne
(74) *Attorney, Agent, or Firm*—Collard & Roe, P.C.

(57) ABSTRACT

In a connector in which a plurality of contacts are held by an insulator and have contacting portions and terminal portions opposite to the contacting portions, the terminal portions are arranged in three rows to have a staggered fashion each between adjacent ones of the three rows. In one of end ones of the three rows, the terminal portions are located to have two pitches different from each other. The contacting portions are arranged in two rows and in a staggered fashion and have a pitch in each of the two rows. It is preferable that the relationship A+B=3X(A<B) is given where X represents the first pitch, A representing the second pitch, and B representing the third pitch.

10 Claims, 8 Drawing Sheets

CONNECTOR IN WHICH A MUTUAL DISTANCE BETWEEN CONTACTS IS ADJUSTED AT TERMINAL PORTIONS THEREOF

This application claims priority to prior Japanese patent application JP 2005-319351, the disclosure of which IS incorporated herein by reference.

BACKGROUND OF THE INVENTION

This invention relates to a connector for connection of a digital signal line and, in particular, to a connector to be mounted to a board or the like.

As a digital transmission system, a TMDS (transition minimized differential signaling) is known. In the TMDS, a digital signal is transmitted by a pair of two signal lines and one ground line.

As modes of digital signal transmission, an unbalanced (single-end) type and a balanced (differential) type are known. In the unbalanced signal transmission, a high level and a low level of a digital signal are distinguished by a potential difference between a ground line and a signal line (one). In the balanced signal transmission, a high level and a low level of a digital signal are distinguished by a potential difference between two signal lines (+, −).

In the balanced signal transmission, two signals on the two signal lines are equal in voltage level to each other and different in phase by 180° from each other. Therefore, even if noise is produced in the two signal lines, the noise is cancelled at a receiver input stage. Thus, as compared with the unbalanced signal transmission, it is easily possible to improve transmission accuracy.

Japanese Patent No. 3564555 (JP-B) discloses a connector for use in the balanced signal transmission. The connector comprises a plurality of contact sets each of which includes a + signal contact and a − signal contact connected to two signal lines, respectively, and a ground contact connected to a ground line. In each contact set, the + signal contact and the − signal contact are arranged symmetrical with respect to the ground contact to form an isosceles triangle. The contact sets are arranged in a single row so that bottom sides of the isosceles triangles are alternately arranged in a staggered fashion. Namely, the isosceles triangles are alternately inverted in position.

In a fitting portion to be fitted to a mating connector, contacting portions of the contacts are arranged in two rows at equal pitches. In each row, the contacts are arranged in a manner such that one + signal contact and one − signal contact are adjacent to each other and one ground contact is arranged next.

On the other hand, at terminal portions to be connected to a board, the contacts are arranged in three rows. The + signal contacts and the − signal contacts are arranged in opposite peripheral rows at equal pitches, respectively, while the ground contacts are arranged in a middle row at equal pitches. Thus, the contacts are arranged in two rows at the contacting portions in the fitting portion and in three rows at the terminal portions. In other words, a pitch-conversion of the contacts is carried out between the contacting portions and the terminal portions.

At the terminal portions, the contacts are connected to wiring patterns formed on the board. The wiring patterns may be formed to extend through a space between adjacent ones of the contacts. For example, two wiring patterns connected to two + signal contacts may be required to pass through a space between two adjacent − signal contacts. In this case, if the space between the two adjacent − signal contacts is narrow, it is difficult to make the two wiring patterns pass therethrough.

In addition, the pitch-conversion might causes differences between the + signal contact and the − signal contact in their lengths and between the signal lines in their lengths. These differences result in occurrence of skew known in the art.

SUMMARY OF THE INVENTION

It is therefore an object of this invention to provide a connector in which a mutual distance between contacts is adjusted at terminal portions thereof without resulting occurrence of skew.

It is still another object of this invention to provide a board adaptable to the above-mentioned connector.

Other objects of the present invention will become clear as the description proceeds.

According to an aspect of the present invention, there is provided a connector comprising an insulator and a plurality of contacts which are held by the insulator, the contacts comprising contacting portions and terminal portions which are opposite to the contacting portions, the contacting portions being arranged in two rows and in a staggered fashion and having a first pitch in each of the two rows, the terminal portions being arranged in three rows to have a staggered fashion each between adjacent ones of the three rows, in one of end ones of the three rows, the terminal portions being located to have a second pitch and a third pitch wider than the second pitch.

It may be arranged that the relationship $A+B=3X(A<B)$ is given where X represents the first pitch, A representing the second pitch, and B representing the third pitch.

It may be arranged that, in another of the end ones, the terminal portions are spaced from each other to have a constant pitch.

It may be arranged that, in a middle one of the three rows, the terminal portions are spaced from each other to have a constant pitch.

It may be arranged that, in the one of the end ones, the terminal portions comprises a plurality of first pairs, the terminal portions in each of the first pairs being spaced from each other with the second pitch, the first pairs being spaced from each other with the third pitch.

It may be arranged that the terminal portions in each of the first pairs are assigned with a + signal and a − signal, respectively.

It may be arranged that, in another of the end ones, the terminal portions comprises a plurality of second pairs, the terminal portions in each of the second pairs being spaced from each other and assigned with a + signal and a − signal, respectively.

It may be arranged that, in a middle one of the three rows, each of the terminal portions are spaced from each other and assigned with a ground signal.

It may be arranged that the terminal portions in each of the first pairs are located on ends of a base of a first isosceles triangle, respectively, the terminal portions in each of the second pairs being located on ends of a base of a second isosceles triangle, respectively, and adjacent ones of the terminal portions in the middle one being located on apexes of the first and second isosceles triangles, respectively.

According to another aspect of the present invention, there is provided a board for use in mounting the above-mentioned connector, comprising particular pairs of wiring patterns to be connected to the terminal portions in the first pairs, and a specific pair of wiring patterns to be connected to the terminal portions in one of the second pairs, the specific pair being placed between the particular pairs.

DESCRIPTION OF THE PREFERRED EMBODIMENTS

Referring to FIGS. 1 to 7, description will be made of a connector according to a first embodiment of this invention.

Figure 1:
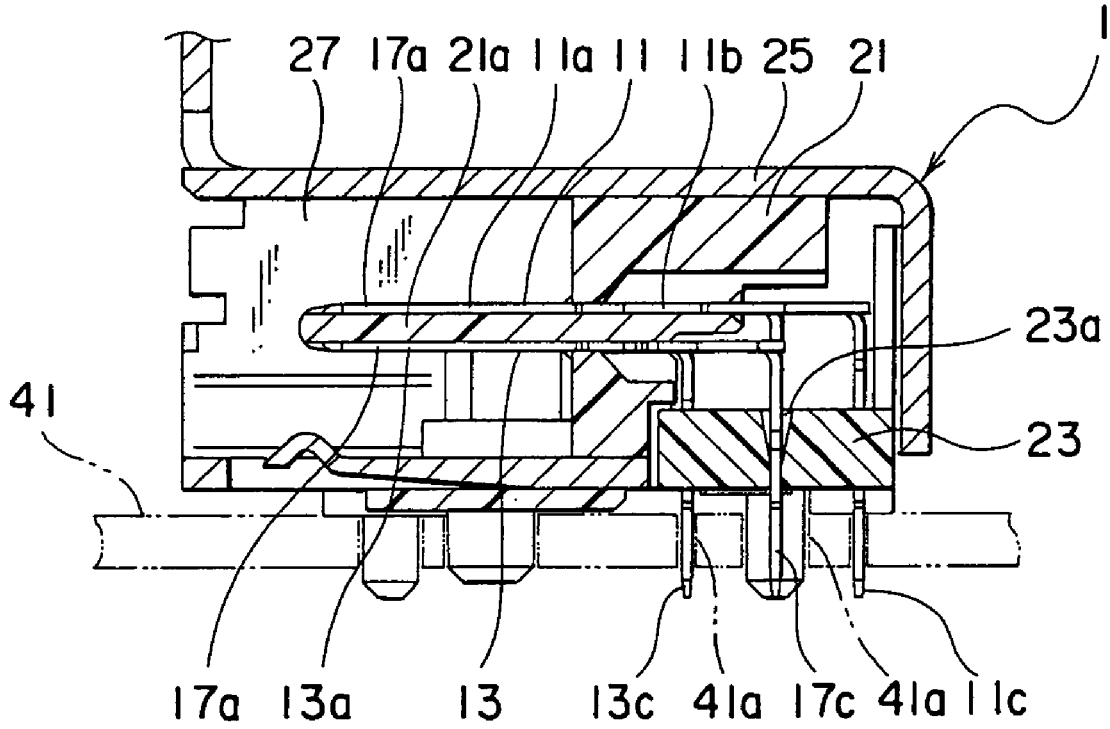
FIG. 1 is a sectional view of a connector according to a first embodiment of this invention.

The connector 1 illustrated in FIG. 1 comprises a plurality of conductive contacts 11, 13, and 17, an insulator or insulating housing 21 holding the contacts 11, 13, and 17, an insulating plate-like locator 23 for aligning the contacts 11, 13, and 17, and a shell 25 formed by a metal plate to cover an outside of the housing 21.

The contacts 11, 13, and 17 include + signal contacts 11 assigned to a + signal, − signal contacts 13 assigned to a − signal, and ground contacts 17 assigned to a ground signal. Each single + signal contact 11 and each single − signal contact 13 form a pair as paired signal contacts 11 and 13. The paired signal contacts 11 and 13 and each single ground contact 17 form an isosceles triangle.

Each of the + signal contacts 11 has a holding portion 11*b*, a contacting portion 11*a* extending from one side of the holding portion 11*b*, and a terminal portion 11*c* extending from the other side of the holding portion 11*b*.

Each of the − signal contacts 13 has a holding portion 13*b*, a contacting portion 13*a* extending from one side of the holding portion 13*b*, and a terminal portion 13*c* extending from the other side of the holding portion 13*b*.

Each of the ground contacts 17 has a ground holding portion 17*b*, a ground contacting portion 17*a* extending from one side of the ground holding portion 17*b*, and a ground terminal portion 17*c* extending from the other side of the ground holding portion 17*b*.

Figure 6:
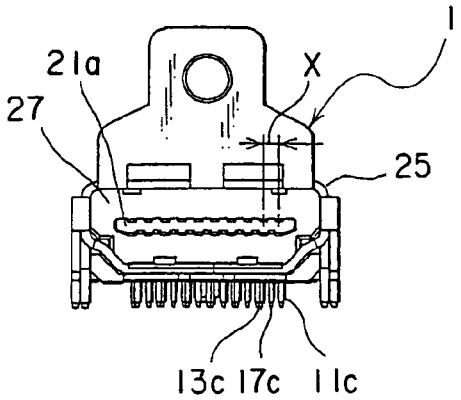
FIG. 6 is a right side view of the connector illustrated in FIG. 1.

As shown in FIGS. 1 and 6, the connector 1 has a fitting portion 27 adapted to be fitted to a mating fitting portion of a mating connector (not shown) as a connection object. The fitting portion 27 has an outer contour defined by one side of the shell 25 having a generally cylindrical shape. In the fitting portion 27, a plate portion 21*a* of the housing 21 is positioned.

Figure 2:
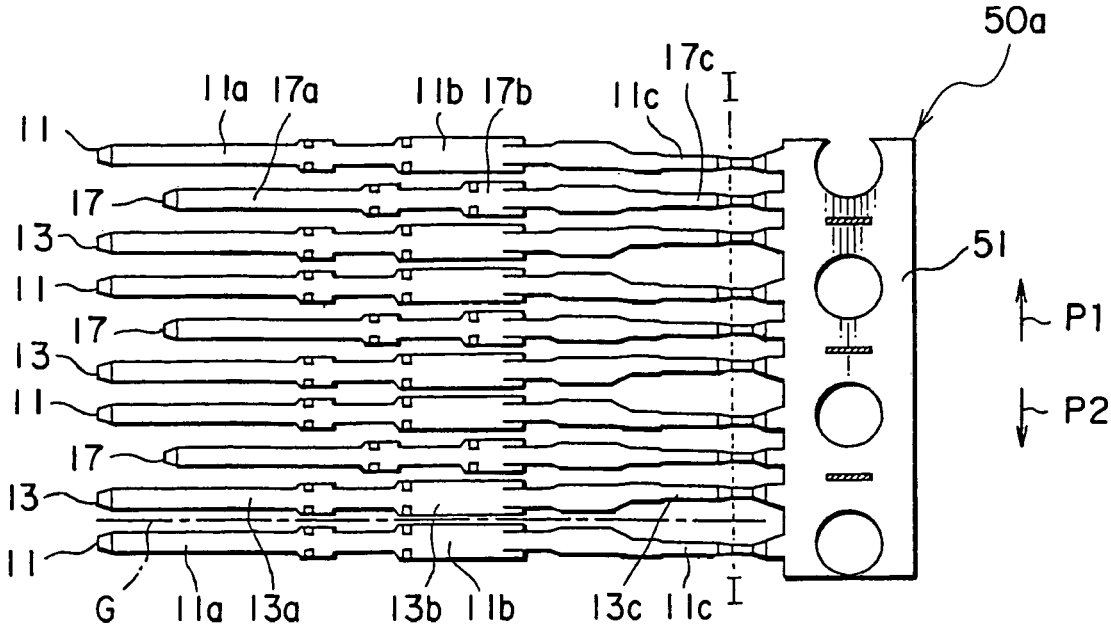
FIG. 2 is a plan view of contacts to be positioned in an upper array of the connector illustrated in FIG. 1 in the state where the contacts are connected to a carrier.

On an upper surface of the plate portion 21*a* of the housing 21 positioned in the fitting portion 27 in FIG. 1, an upper array of the contacting portions 11*a* and 13*a* and the ground contacting portion 17*a* illustrated in FIG. 2 is disposed. On a lower surface of the plate portion 21*a* of the housing 21 positioned in the fitting portion 27 in FIG. 1, a lower array of the contacting portions 11*a* and 13*a* and the ground contacting portion 17*a* illustrated in FIG. 3 is disposed.

The terminal portions 11*c* and 13*c* and the ground terminal portions 17*c* are perpendicularly bent from the holding portions 11*b* and 13*b* and the ground holding portion 17*b*, respectively, to extend through locator holes 23*a* formed on the locator 23. The connector 1 according to the first embodiment is generally called an angle-type connector. The connector 1 is mounted to a circuit board 41 as a connection object illustrated in FIG. 1.

As shown in FIG. 1, the contacting portions 11*a* and 13*a* and the ground contacting portions 17*a* are arranged on a contacting side in two rows in a staggered fashion or pattern while the terminal portions 11*c* and 13*c* and the ground terminal portions 17*c* are arranged on a terminal side in three rows with the ground terminal portions 17*c* located in a middle row among the three rows.

Figure 3:
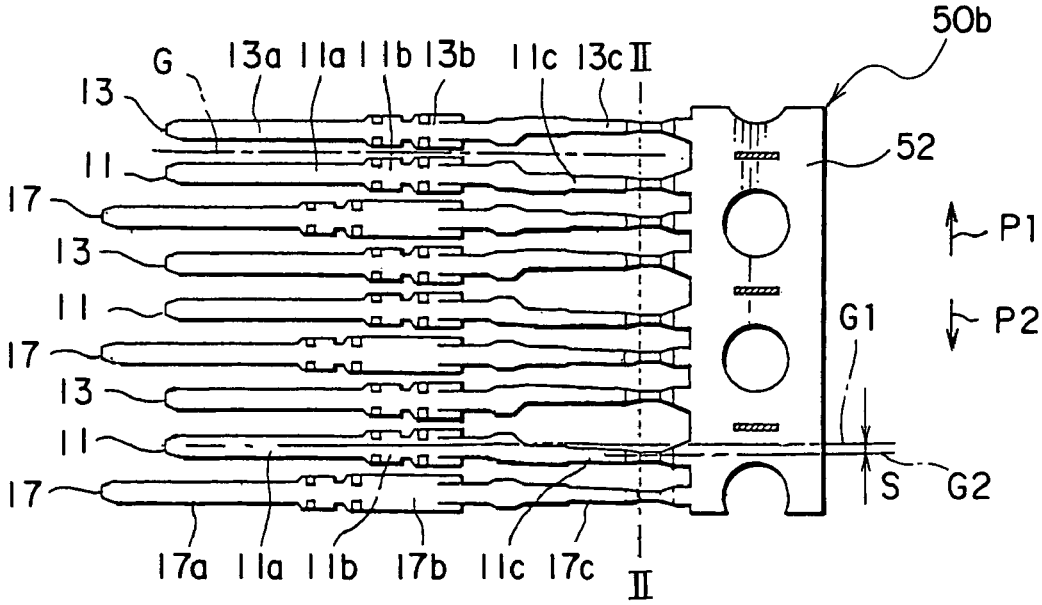
FIG. 3 is a plan view of contacts to be positioned in a lower array of the connector illustrated in FIG. 1 in the state where the contacts are connected to a carrier.
Figure 4:
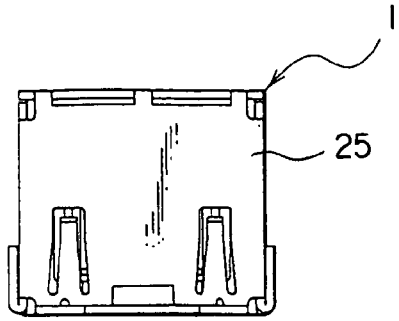
FIG. 4 is a plan view of the connector illustrated in FIG. 1.
Figure 5:
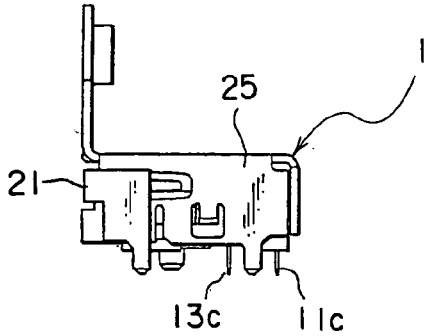
FIG. 5 is a side view of the connector illustrated in FIG. 1.

With reference to FIGS. 2 and 3 in addition to FIG. 1, the description will be directed to a state where the signal contacts 11 and 13 and the ground contacts 17 are connected to carriers 51 and 52.

In manufacturing the connector 1, use is made of a first contact member 50*a* shown in FIG. 2 and a second contact member 50*b* shown in FIG. 3. The first and the second contact members 50*a* and 50*b* can be manufactured by punching a metal plate using a press. Ends of the signal contacts 11 and 13 and the ground contacts 17 are connected to the carriers 51 and 52 to be moved in the pitch direction P1 during manufacturing.

The signal contacts 11 and 13 and the ground contacts 17 extend in a direction parallel to an axis G. The signal contacts 11 and 13 and the ground contacts 17 are held by the housing 21 so that the contacts are combined on a virtual plane containing the axis G and spaced from one another in pitch directions P1 and P2 perpendicular to the axis G. After inserted into the housing 21, the signal contacts 11 and 13 and the ground contacts 17 are separated from the carriers 51 and 52 with cutting along a line I-I in FIG. 2 and a line II-II in FIG. 3.

In the first contact member 50*a* of FIG. 2, each + signal contact 11 and each − signal contact 13 are symmetrical with respect to the axis G. The contacting portions 11*a* and 13*a* and the ground contacting portions 17*a* are arranged in the upper array at equal pitches. Namely, the contacting portions 11*a* and 13*a* are spaced to have a first pitch in each of the two rows. The terminal portions 11*c* and 13*c* and the ground terminal portions 17*c* are arranged on the terminal side with being pitch-converted to have various and regular pitches.

In the second contact member 50*b* of FIG. 3, the contacting portions 11*a* and 13*a* and the ground contacting portions 17*a* are arranged in the lower array at equal pitches. However, the contacting portions 11*a* and 13*a* and the ground contacting portions 17*a* in the lower array are sifted in position with respect to those in the upper array in the pitch direction P2. In addition, the terminal portions 11*c* of the + signal contacts 11 are shifted in position with respect to the contacting portions 11*a* in the pitch direction P2. Specifically, each of the terminal portions 11*c* is arranged in the terminal side on an axis G2 shifted by S from a center axis G1 of the + signal contact 11. Likewise, the terminal portions 13*c* of the − signal contacts 13 are shifted in position with respect to the contacting portions 13*a* in the pitch direction P1. Specifically, the terminal portion 13*c* of each − signal contact 13 is shifted from a center axis of the − signal contact 13. Thus, the terminal portions 11*c* and 13*c* and the ground terminal portions 17*c* are arranged on the terminal side with being pitch-converted to have various and regular pitches. By shifting the terminal portions 11*c* and 13*c* in position, a pitch (see FIG. 6) between the terminal portion 11*c* of the + signal contact 11 and the terminal portion 13*c* of the − signal contact 13 adjacent thereto is wider than that between the contacting portions 11*a* and 13*a* and the ground contacting portions 17*a*.

Figure 7:
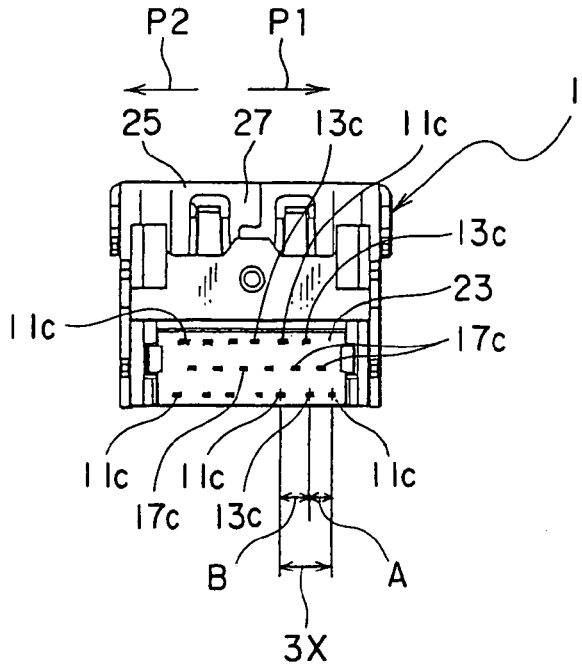
FIG. 7 is a bottom view of the connector illustrated in FIG. 1.

With reference to FIGS. 6 and 7, the description will be directed to arrangement of the contacts on the terminal side of the connector.

As described in the above, the terminal portions 11*c* and 13*c* and the ground terminal portions 17*c* are arranged on the terminal side in three rows. The ground terminal portions 17*c* are located in the middle row among the three rows. The terminal portions 11*c* and 13*c* are alternately located in each of end rows among the three rows in the pitch directions P1 and P2. More particularly, the terminal portions 11*c* and 13*c* of the first contact member 50*a* are arranged in an outer one of the end rows while the terminal portions 11*c* and 13*c* of the second contact member 50*b* are arranged in an inner one of the end rows.

In FIG. 7, the terminal portions 17*c* of the ground contacts 17 in the middle row are arranged at constant pitches in the pitch directions P1 and P2. The + signal contacts 11 and the − signal contacts 13 in the outer row are converted so that the pitch in each pair is narrow and the pitch between adjacent pairs is wide. As a result, in the outer row, the terminal portions 11*c* and 13*c* are located to have a second pitch and a third pitch wider than the second pitch.

In addition, the terminal portions 11*c*, 13*c*, and 17*c* are placed in accordance with a first isosceles triangle and a second isosceles triangle in the manner which will be described in the following. The terminal portions 11*c* in each of their pairs are located on ends of a base of the first isosceles triangle, respectively. The terminal portions 13*c* in each of their pairs are located on ends of a base of the second isosceles triangle, respectively. Adjacent ones of the terminal portions 17*c* are located on apexes of the first and second isosceles triangles, respectively.

Herein, the pitch between the contacting portions 11*a* and 13*a* in each pair is represented by X. The pitch between the terminal portions 11*c* and 13*c* in each pair is represented by A. The pitch between adjacent pairs of the signal contacts 11 and 13 is represented by B. Then, the relationship A+B=3X (A<B) is given. That is, the sum of the pitch A in each pair and the pitch B between adjacent pairs is equal to three times the pitch X of the contacting portions 11*a* and 13*a* (A+B=3X).

When the sum of the pitch of the terminal portions 11*c* and 13*c* in each pair and the pitch between adjacent pairs is equal to three times the pitch of the contacting portions 11*a* and 13*a*, pitch conversion of the contacts 11 and 13 is easy and the contacts 11 and 13 can be equal in length to one another. Therefore, no skew occurs.

Figure 8:
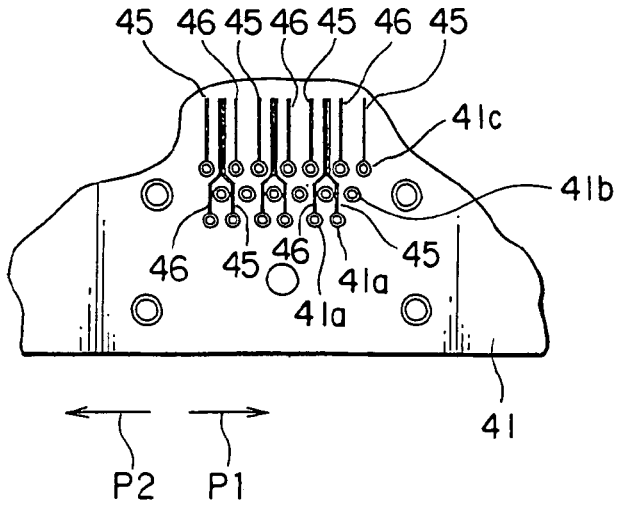
FIG. 8 is a plan view of a circuit board to which the connector illustrated in FIG. 1 is to be mounted.

With reference to FIG. 8 in addition, the description will be made about a printed circuit board 41 to which the above-mentioned connector 1 is to be mounted.

The circuit board 41 is provided with a plurality of through holes 41*a*, 41*b*, and 41*c* and wiring patterns 45 and 46. The through holes 41*a*, 41*b*, and 41*c* are arranged in three rows comprising a first row, a second row, and third row. The through holes 41*a* in the first row are arranged at constant pitches in the pitch directions P1 and P2. The through holes 41*b* in the second row are arranged at constant pitches in the pitch directions P1 and P2. The through holes 41*c* in the third row are arranged are pitch-converted in the pitch directions P1 and P2 in the manner which will later be described.

When the connector is mounted on the circuit board 41, the through holes 41*b* of the second row are inserted or connected with the ground terminal portions 17*c*, respectively. The through holes 41*a* of the first row are inserted or connected with the terminal portions 11*c* and 13*c*, alternately. Therefore, adjacent two of the through holes 41*a* of the first row are connected to the pair of the signal contacts 11 and 13 and will be called a pair. The through holes 41*c* of the third row are inserted or connected with the terminal portions 11*c* and 13*c*, alternately. Therefore, adjacent two of the through holes 41*c* of the third row are connected to the pair of the signal contacts 11 and 13 and will also be called a pair. Herein, the pitch in each pair of the through holes 41*c* is determined narrow and the pitch between adjacent pairs is determined wide.

The wiring patterns 45 and 46 are connected to the through holes 41*a* and 45*c* and extended therefrom in a same direction as illustrated in FIG. 8. In this event, the wiring patterns 45 and 46 connected to the pair of the through holes 41*a* are led out through a space between the pair of the through holes 41*c*. The wiring patterns 45 and 46 may be called a − signal pattern and a + signal pattern, respectively. The wiring patterns 45 and 46 connected to the pair of the through holes 41*a* will be referred to as specific pairs of wiring patterns. The wiring patterns 45 and 46 connected to the pair of the through holes 41*c* will be referred to as particular pairs of wiring patterns.

In order to assemble the connector 1, the terminal portions 11*c* and 13*c* and the ground terminal portions 17*c* of the contacts 11, 13, and 17 in the lower array are generally perpendicularly bent with respect to the holding portions 11*b* and 13*b* and the ground holding portion 17*b*. Then, the contacting portions 11*a* and 13*a* and the ground contacting portions 17*a* are provisionally inserted to the housing 21. After the carrier 51 is bent and separated, the holding portions 11*b* and 13*b* and the ground holding portions 17*b* are press-fitted into the housing 21.

Further, the terminal portions 11*c* and 13*c* and the ground terminal portions 17*c* of the contacts 11, 13, and 17 in the upper array are generally perpendicularly bent with respect to the holding portions 11*b* and 13*b* and the ground holding portion 17*b*. Then, the contacting portions 11*a* and 13*a* and the ground contacting portions 17*a* are provisionally inserted to the housing 21. After the carrier 52 is bent and separated, the holding portions 11*b* and 13*b* and the ground holding portions 17*b* are press-fitted into the housing 21. Thereafter, the locator 23 and the shell 25 are coupled to the housing 21.

Referring to FIGS. 9 to 15, description will be made of a connector according to a second embodiment of this invention. Similar parts or portions are designated by like reference numerals.

Figure 9:
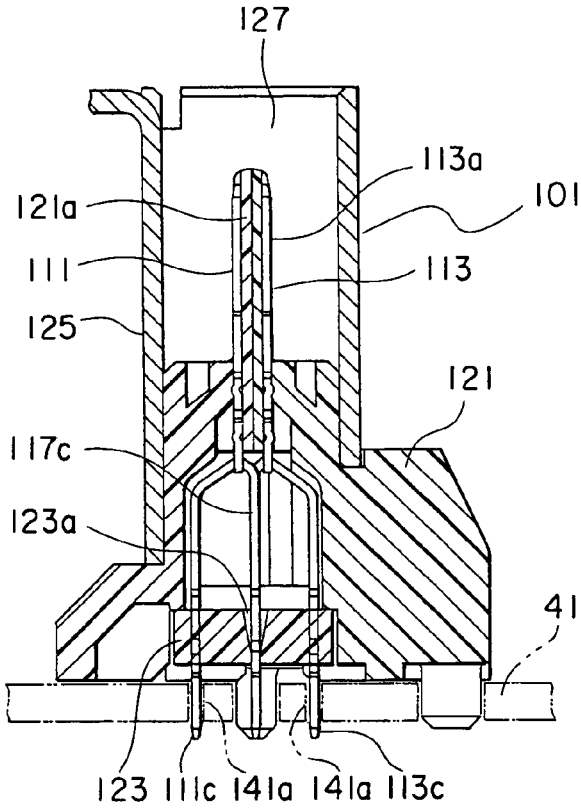
FIG. 9 is a sectional view of a connector according to a second embodiment of this invention.

The connector 101 illustrated in FIG. 9 comprises a plurality of conductive contacts 111, 113, and 117, an insulating housing 121 holding the contacts 111, 113, and 117, a locator 23 for aligning the contacts 111, 113, and 117, and a shell 125 formed by a metal plate to cover the housing 121.

The contacts 111, 113, and 117 include + signal contacts 111, − signal contacts 113, and ground contacts 117. Each single + signal contact 111 and each single − signal contact 113 form a pair as paired signal contacts 111 and 113. The contacts 111, 113, and 117 are arranged so that each pair of the + signal contact 111 and the − signal contact 113 and each single ground contact 117 form an isosceles triangle.

Each of the + signal contacts 111 has a holding portion 111*b*, a contacting portion 111*a* extending from one side of the holding portion 111*b*, and a terminal portion 111*c* extending from the other side of the holding portion 111*b*.

Each of the − signal contacts 113 has a holding portion 113*b*, a contacting portion 113*a* extending from one side of the holding portion 113*b*, and a terminal portion 113*c* extending from the other side of the holding portion 113*b*.

Each of the ground contacts 117 has a ground holding portion 117*b*, a ground contacting portion 117*a* extending from one side of the ground holding portion 117*b*, and a ground terminal portion 117*c* extending from the other side of the ground holding portion 117*b*.

Figure 10:
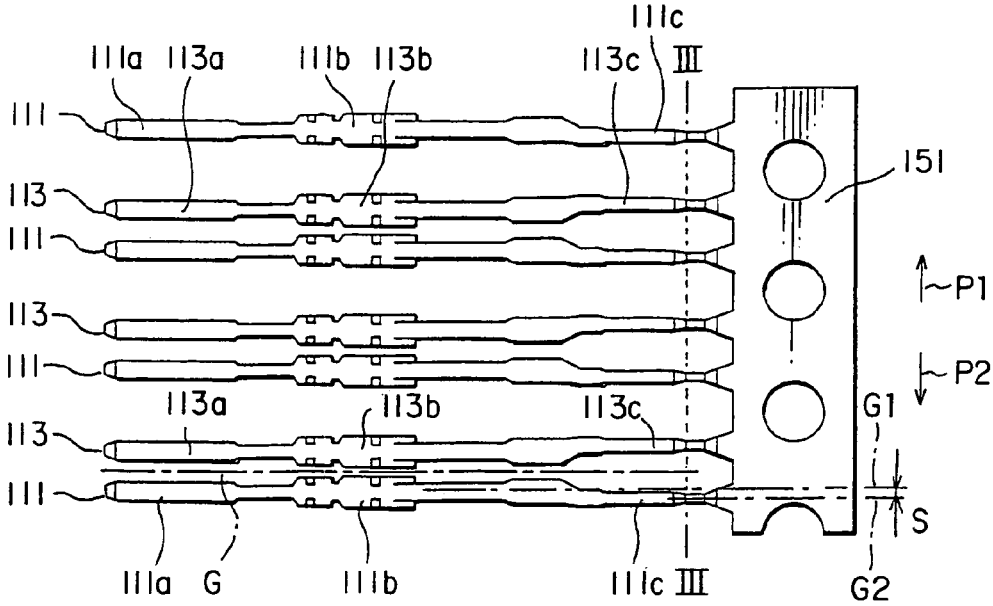
FIG. 10 is a plan view of signal contacts to be incorporated into the connector illustrated in FIG. 9 in the state where the contacts are connected to a carrier.
Figure 11:
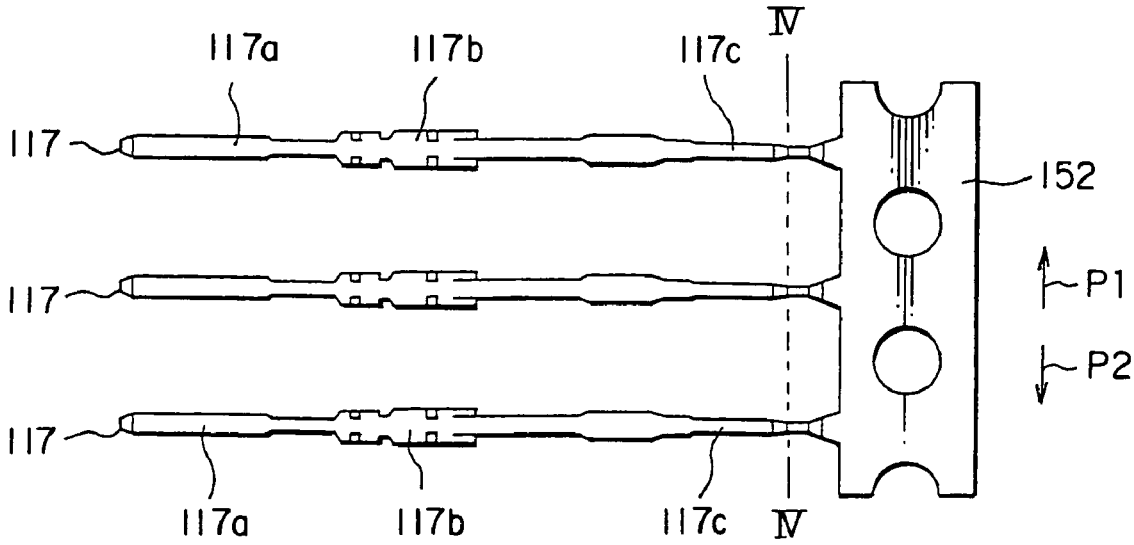
FIG. 11 is a plan view of ground contacts to be incorporated into the connector illustrated in FIG. 9 in the state where the contacts are connected to a carrier.
Figure 12:
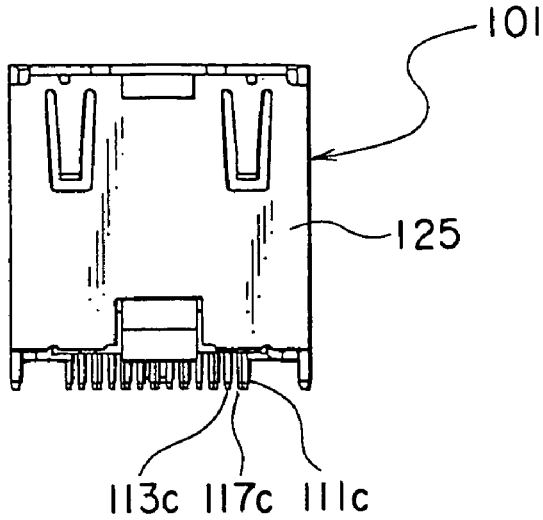
FIG. 12 is a plan view of the connector illustrated in FIG. 9.
Figure 13:
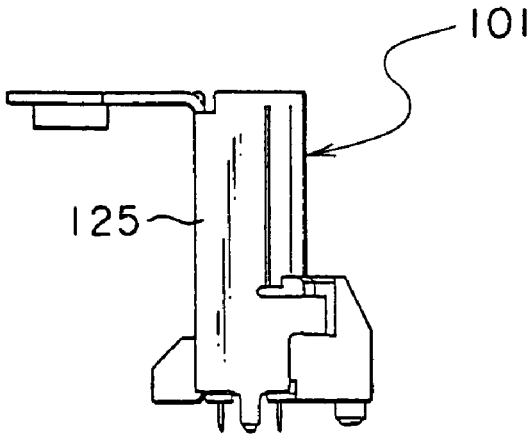
FIG. 13 is a side view of the connector illustrated in FIG. 9.
Figure 14:
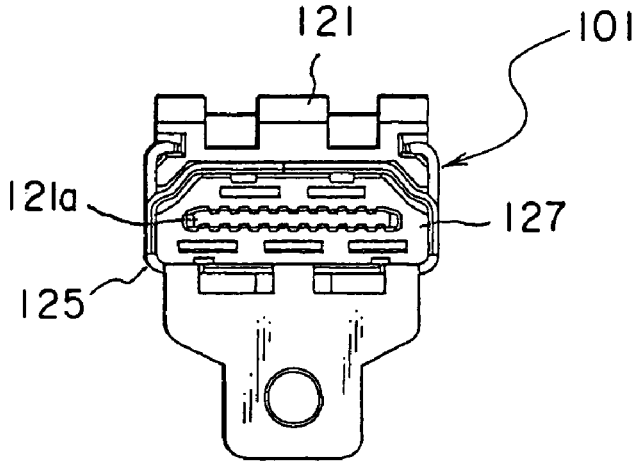
FIG. 14 is a plan view of the connector illustrated in FIG. 9.
Figure 15:
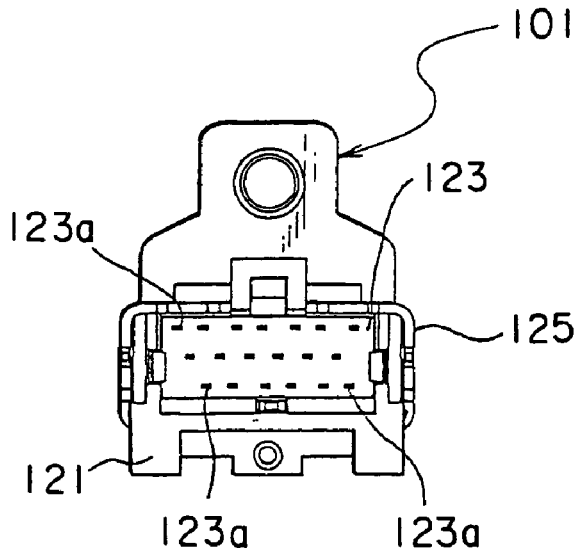
FIG. 15 is a bottom view of the connector illustrated in FIG. 9.

The signal contacts 111 and 113 and the ground contacts 117 extend in a direction parallel to an axis G (see FIGS. 10 and 11). The signal contacts 111 and 113 and the ground contacts 117 are held by the housing 121 so that the contacts are combined on a virtual plane containing the axis G and spaced from one another in pitch directions P1 and P2 (see FIGS. 10 and 11) perpendicular to the axis G.

The signal contacts 111 and 113 are connected to a carrier 151. Specifically, ends of the terminal portions 111*c* and 113*c* are connected to the carrier 151. In this state, the signal contacts 111 and 113 are press-fitted to the housing 121 and thereafter cut and separated from the carrier 151 along a line III-III in FIG. 10.

The ground contacts 117 are connected to a carrier 152. Specifically, ends of the ground terminal portions 117*c* are connected to the carrier 152. In this state, the ground contacts 117 are press-fitted to the housing 121 and thereafter cut and separated from the carrier 152 along a line IV-IV in FIG. 11.

The connector 101 has a fitting portion 127 adapted to be fitted to a mating fitting portion of a mating connector (not shown). The fitting portion 127 has an outer contour defined by one side of the shell 125 having a generally cylindrical shape. In the fitting portion 127, a plate portion 121*a* of the housing 121 is positioned.

On one surface of the plate portion 121*a* of the housing 121 positioned in the fitting portion 127, the contacting portions 111*a* and 113*a* on one side illustrated in FIG. 10 are disposed. On the other surface of the plate portion 121*a* of the housing 121 positioned in the fitting portion 127, the ground contacting portions 117*a* on the other side illustrated in FIG. 11 are disposed.

The terminal portions 111*c* and 113*c* and the ground terminal portions 117*c* are connected to the holding portions 111*b* and 113*b* and the ground holding portion 117*c*, respectively, to extend through locator holes 123*a* formed on the locator 123. The connector 101 according to the second embodiment is generally called a straight-type connector. The connector 101 is mounted to the circuit board 41 as a connection object illustrated in FIG. 9.

The contacting portions 111*a* and 113*a* and the ground contacting portions 117*a* are arranged in two rows in a staggered fashion or pattern while the terminal portions 111*c* and 113*c* and the ground terminal portions 117*c* are arranged in three rows with the ground terminal portions 117*c* located in a middle row among the three rows.

Referring to FIG. 10, each + signal contacts 111 and each − signal contacts 113 are symmetrical with respect to the axis G. The contacting portions 111*a* and 113*a* of the + signal contacts 111 and the − signal contacts 113 are arranged at equal pitches.

As shown in FIG. 10, the terminal portions 111*c* of the + signal contacts 111 are shifted in position with respect to the contacting portion 111*a* in the pitch direction P2. Specifically, the terminal portion 111*c* of each + signal contact 111 is arranged on an axis G2 shifted by S from a center axis G1 of the + signal contact 111. Likewise, the terminal portions 113*c* of the − signal contacts 113 are shifted in position with respect to the contacting portion 113*a* in the pitch direction P1. Specifically, the terminal portion 113*c* of each − signal contact 113 is shifted from a center axis of the − signal contact 113.

Like in the connector 1 illustrated in FIGS. 6 and 7, the terminal portions 111*c* and 113*c* are shifted in position. With this structure, the pitch between the terminal portion 111*c* of the + signal contact 111 and the terminal portion 113*c* of the − signal contact 113 adjacent thereto is wider than that between the contacting portions 111*a* and 113*a* and the ground contacting portions 117*a*.

The pitch between the contacting portions 111*a* and 113*a* in each pair is represented by X. The pitch between the terminal portions 111*c* and 113*c* in each pair is represented by A. The pitch between adjacent pairs of the signal contacts 111 and 113 is represented by B. Then, the relationship $A+B=3X(A<B)$ is given.

When the sum of the pitch of the terminal portions 111*c* and 113*c* in each pair and the pitch between adjacent pairs is equal to three times the pitch of the contacting portions 111*a* and 113*a*, pitch conversion of the contacts 111 and 113 is easy and the contacts 111 and 113 can be equal in length to one another. Therefore, no skew occurs.

In order to assemble the connector 101, the terminal portions 111*c* and 113*c* of the signal contacts 111 and 113 on one side are provisionally inserted to the housing 121. After the carrier 151 is bent and separated, the holding portions 111*b* and 113*b* are press-fitted into the housing 121.

Further, the ground contacting portions 117*a* of the ground contacts 117 on one side are provisionally inserted to the housing 121. After the carrier 152 is bent and separated, the ground holding portions 117*b* are press-fitted into the housing 121. The signal contacts 111 and 113 and the ground contacts 117 on the other side are similarly press-fitted. Thereafter, the locator 123 and the shell 215 are coupled to the housing 121.

In the angle-type connector, the contacts in the upper array and the contacts in the lower array can be formed by a single molding die and another single molding die, respectively. In the straight-type connector, the signal contacts 111 and 113 can be formed by a single molding die and the ground contacts 117 can be formed by another single molding die. Thus, considering the shape of the contact and material cutting, the number of molding dies required to manufacture the contacts can be reduced.

In the above-mentioned connector, the terminal portions are shifted in position with respect to the contacting portions. With this structure, the pitch between the + signal contact and the − signal contact is wider than that between the signal contact and the ground contact. Thus, the through holes of the board can be arranged alternately at a second pitch and at a third pitch. It is therefore possible to arrange two conductor patterns between the through holes of the circuit board. The contacts (two signal contacts and one ground contact) in each set can be equal in length to one another so that occurrence of skew is prevented.

Although this invention has been described in conjunction with the preferred embodiments thereof, this invention may be modified in various other manners within the scope of the appended claims. This invention is applicable to a high-frequency connector for connection of a signal circuit of a so-called differential signal transmission system in which an information signal is transmitted as differential signals by the use of two signal lines.

What is claimed is:

1. A connector comprising:

an insulator; and a plurality of contacts which are held by the insulator;

the contacts comprising:

contacting portions; and terminal portions which are opposite to the contacting portions;

the contacting portions being arranged in two rows and in a staggered fashion and having a first pitch in each of the two rows, the terminal portions being arranged in three rows to have a staggered fashion each between adjacent ones of the three rows, in one of end ones of the three rows, the terminal portions being located to have a second pitch and a third pitch wider than the second pitch.

2. The connector according to claim 1, wherein the relationship $A+B=3X(A<B)$ is given where X represents the first pitch, A representing the second pitch, and B representing the third pitch.

3. The connector according to claim 1, wherein, in another of the end ones, the terminal portions are spaced from to each other to have a constant pitch.

4. The connector according to claim 1, wherein, in a middle one of the three rows, the terminal portions are spaced from each other to have a constant pitch.

5. The connector according to claim 1, wherein, in the one of the end ones, the terminal portions comprises a plurality of first pairs, the terminal portions in each of the first pairs being spaced from each other with the second pitch, the first pairs being spaced from each other with the third pitch.

6. The connector according to claim 5, wherein the terminal portions in each of the first pairs are assigned with a + signal and a − signal, respectively.

7. The connector according to claim 6, wherein, in another of the end ones, the terminal portions comprises a plurality of second pairs, the terminal portions in each of the second pairs being spaced from each other and assigned with a + signal and a − signal, respectively.

8. The connector according to claim 7, wherein, in a middle one of the three rows, each of the terminal portions are spaced from each other and assigned with a ground signal.

9. The connector according to claim 8, wherein:

the terminal portions in each of the first pairs are located on ends of a base of a first isosceles triangle, respectively;

the terminal portions in each of the second pairs are located on ends of a base of a second isosceles triangle, respectively; and adjacent ones of the terminal portions in the middle one are located on apexes of the first and second isosceles triangles, respectively.

10. A board for use in mounting the connector according to claim 1, comprising:

particular pairs of wiring patterns to be connected to the terminal portions in the first pairs; and a specific pair of wiring patterns to be connected to the terminal portions in one of the second pairs, the specific pair being placed between the particular pairs.

* * * * *